US005136724A

United States Patent [19]

Grilliot et al.

[11] Patent Number: 5,136,724

[45] Date of Patent: * Aug. 11, 1992

[54] FIREFIGHTER'S COMBINATION TROUSERS AND SAFETY HARNESS

[76] Inventors: William L. Grilliot; Mary I. Grilliot, both of 1986 Home Ave., Dayton, Ohio 45417

[ * ] Notice: The portion of the term of this patent subsequent to Aug. 6, 2008 has been disclaimed.

[21] Appl. No.: 712,734

[22] Filed: Jun. 10, 1991

Related U.S. Application Data

[63] Continuation of Ser. No. 487,378, Mar. 2, 1990, Pat. No. 5,036,548.

[51] Int. Cl.[5] ..... A41D 13/00

[52] U.S. Cl. ..... 2/81; 2/79; 2/227; 182/3

[58] Field of Search ..... 2/79, 81, 227, 229, 2/235; 182/3; 248/925

[56] References Cited

U.S. PATENT DOCUMENTS

| | | | |
|---|---|---|---|
| 2,979,153 | 4/1961 | Hoagland | 2/81 |
| 3,176,793 | 4/1965 | Hlacia | 182/3 |
| 4,302,847 | 12/1981 | Miles | 2/227 |
| 4,632,217 | 12/1986 | Markwell | 182/3 |
| 4,687,074 | 8/1987 | Green | 182/3 |
| 4,731,882 | 3/1988 | Ekman | 2/79 |
| 4,817,210 | 4/1989 | Aldridge | 2/81 |

FOREIGN PATENT DOCUMENTS

| | | | |
|---|---|---|---|
| 2529559 | 1/1978 | Fed. Rep. of Germany | 182/3 |
| 2292492 | 6/1976 | France | 182/3 |

OTHER PUBLICATIONS

PMI Catalog Page, published in 1988.

Atlas Safety Equipment Co., Inc. Catalogue, p. 8.

*Primary Examiner*—Werner H. Schroeder

*Assistant Examiner*—Diana L. Biefeld

*Attorney, Agent, or Firm*—Jacox & Meckstroth

[57] ABSTRACT

A firefighter's trousers and safety harness combination. At least a portion of the safety harness is positioned and supported within the firefighter's trousers. Preferably, the safety harness has connection parts which are exterior of the firefighter's trousers and which are connectible to a portion of the firefighter's trousers to secure the safety harness and the firefighter's trousers upon the firefighter who wears the trousers.

11 Claims, 3 Drawing Sheets

FIREFIGHTER'S COMBINATION TROUSERS AND SAFETY HARNESS

RELATED APPLICATION

This application is a continuation of patent application Ser. No. 07/487,378, filed Mar. 2, 1990, now U.S. Pat. No. 5,036,548, and is incorporated herein by reference.

BACKGROUND OF THE INVENTION

In many large cities the duties of a firefighter include firefighting in the upper floors of a skyscraper type of building. In many situations, a firefighter is required to wear a safety harness and carry rope which is capable of extending over several floors. In this manner, if a firefighter is trapped above a fire floor and the fire may advance upwardly, the firefighter can use the safety harness and the rope to lower himself/herself outside the building to a safe location.

A problem exists as the firefighter wears such a safety harness. The bulk of the firefighter's garments plus the bulk of the safety harness is considered objectionable. Furthermore, the safety harness positioned upon the garments is subjected to high heat conditions as the firefighter fights a fire. The safety harness therefore may be damaged as the firefighting occurs.

Also, when a firefighter expects to fight a fire in the upper stories of a skyscraper type of building the firefighter must don a safety harness, in addition to donning firefighting protective clothing. Therefore, additional time is required to prepare for high level firefighting conditions.

It is an object of this invention to provide in combination, a firefighter's protective trousers and a safety harness.

It is another object of this invention to provide such a combination in which the firefighter's trousers and the safety harness are donned together, as a unit.

It is another object of this invention to provide such a combination of a firefighter's protective trousers and safety harness in which the safety harness is protected by the firefighter's trousers.

It is another object of this invention to provide such a combination of a firefighter's protective trousers and safety harness in which the trousers and the safety harness are secured to the firefighter by the same attachment means.

Other objects and advantages of this invention reside in the construction of parts, the combination thereof, the method of production, the method of assembly, and the mode of use, as will become more apparent from the following description.

SUMMARY OF THE INVENTION

This invention comprises, in combination, a firefighter's protective trousers and a safety harness. The safety harness is carried by the firefighter's protective trousers and includes a support element which is exterior of the trousers. Preferably, the safety harness has attachment portions and the trousers have attachment portions, all of which are attached together in substantially the same operation. Thus, the trousers and the safety harness are donned together and secured together as a unit. Therefore, the time involved in donning the trousers and the safety harness is minimal.

DETAILED DESCRIPTION OF THE PREFERRED EMBODIMENT

Trousers 10 of this invention comprise an outer shell 12 and an inner liner 14. The outer shell 12 is of abrasion resistant and flame resistant material. The inner liner 14 may comprise one or more layers and is of thermal protective material and moisture protective material. The outer shell 12 has leg portions **12*a* and 12*b*. The inner liner 14 has leg portions 14*a* and 14*b***.

Figure 2:
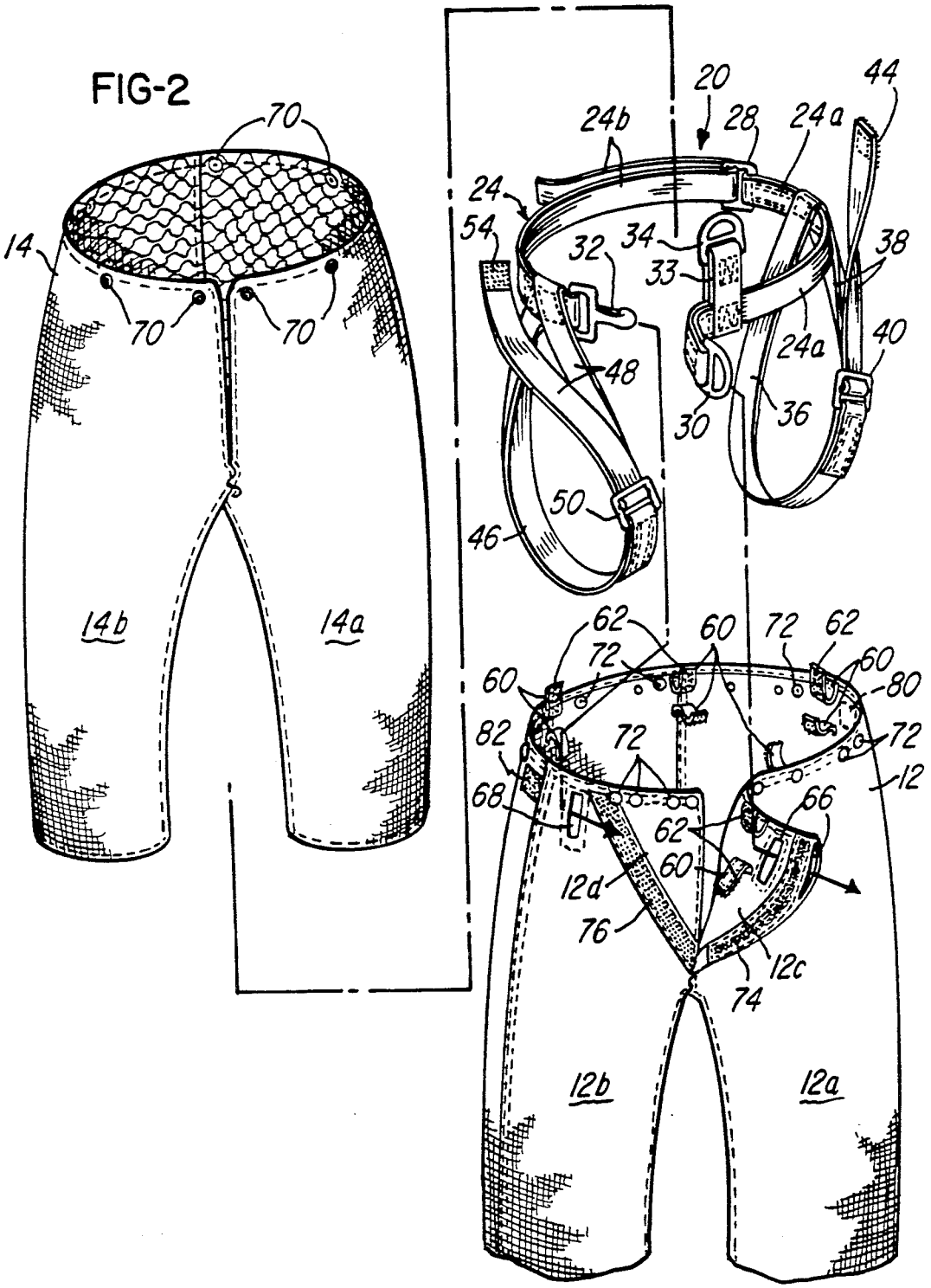
FIG. 2 is an exploded perspective view, drawn on a larger scale than FIG. 1, illustrating the assembly of a firefighter's trousers and safety harness combination unit.

A safety harness 20 of this invention is best shown in FIG. 2. The safety harness 20 comprises a belt 24, which includes a belt section **24*a* and a belt section 24*b*. The belt sections 24*a* and 24*b* are joined together by a slide fastener 28, which provides means for adjustment of the belt sections 24*a* and 24*b*, one with respect to the other. Attached to the end of the belt section 24*a* is a connection part in the form of an annular connector member 30. Attached to the end of the belt section 24*b* is a securing member in the form of a snap connector 32. The annular connector member 30 and the snap connector 32** are complementary connector means which have attachment portions.

Attached to the belt section **24*a* adjacent the annular connector member 30 is a short strap 33. Secured to the end of the short strap 33 is an annular support connector member 34**.

Attached to the belt section **24*a* intermediate the ends thereof, and extending downwardly therefrom, is a support strap 36. Also attached to the belt section 24***a* intermediate the ends thereof and extending downwardly therefrom is a support strap 38. It is to be understood that the support straps 36 and 38 may comprise a single strap. A slide fastener 40 connects the support strap 36 to the support strap 38. Thus, the support straps 36 and 38, and the slide fastener 40 form a support loop which comprises a support part of the safety harness 20. At the end of the support strap 38 is a hook and pile element 44.

Attached to the belt section 24*b* and extending downwardly therefrom is a support strap 46. Also, attached to the belt section 24*b* and extending downwardly therefrom is a support strap 48. It is to be understood that the support straps 46 and 48 may comprise a single strap. A slide fastener 50 connects the support strap 46 to the support strap 48. Thus, the support straps 46 and 48, and the slide fastener 50 form a support loop which comprises a support part of the safety harness 20. At the end of the support strap 48 is a hook and pile element 54.

Figure 1:
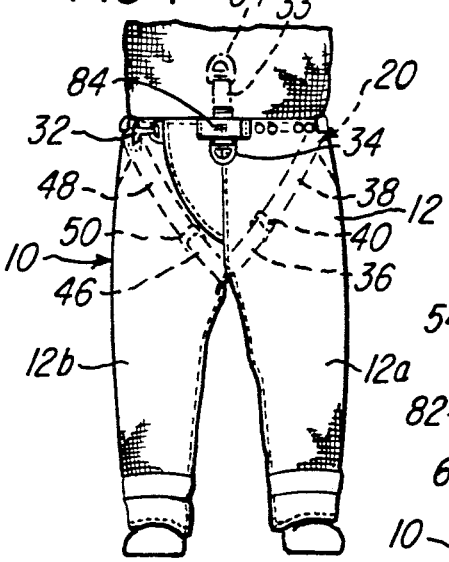
FIG. 1 is a front elevational view showing a firefighter's trousers and safety harness combination unit of this invention.
Figure 4:
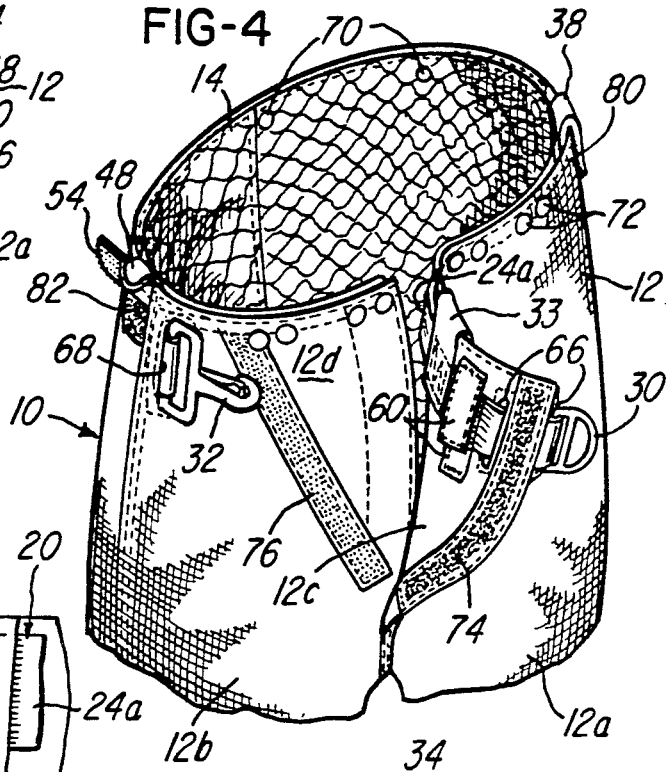
FIG. 4 is a fragmentary front perspective view, drawn on substantially the same scale as FIG. 3, showing a portion of the firefighter's trousers and safety harness unit after assembly of the safety harness within the firefighter's trousers.
Figure 3:
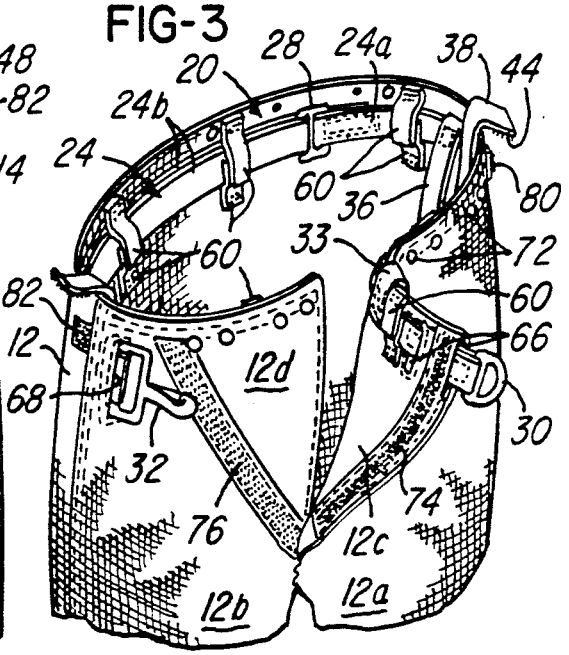
FIG. 3 is a fragmentary front perspective view, drawn on substantially the same scale as FIG. 2, illustrating attachment of the safety harness within the shell of the firefighter's trousers.

Within the shell 12, at the upper part thereof, are pairs of tabs 60, as best shown in FIG. 2. Each tab 60 has an end portion secured to the shell 12. Each tab 60 also has an opposite end portion to which is secured a hook and pile member 62. The belt sections 24*a* and 24*b* are positioned between each of the pairs of tabs 60, and each of the pairs of tabs 60 is attached together by the hook and pile member 62, as shown in FIG. 3. The shell 12 has a flap 12*c* which has a loop 66 therethrough. The shell 12 has a flap 12*d* which has a loop 68 therethrough. The belt section 24*b* extends through the loop 68 in the flap 12*d*. Thus, the snap connector 32 is exterior of the shell 12. The belt section 24*a* extends through the loop 66 in the flap 12*c*. Thus, the loops 66 and 68 join the belt sections 24*a* and 24*b* to the flaps 12*c* and 12*d* and serve as attachment means or securing means connecting the fastener means of the safety harness 20 to the connection portion of the firefighter's trousers 10. Thus, the connector member 30 is exterior of the shell 12, as shown in FIG. 4. Thus, the shell 12 carries the belt sections 24*a* and 24*b*, and the support straps 36, 38, 46, and 48 extend downwardly from the belt sections 24*a* and 24*b*, as the support straps 36, 38, 46, and 48 are within the shell 12. Therefore, the tabs 60 and the loops 66 and 68 serve as support means for the safety harness 20. Therefore, the upper portion of the shell 12 serves as a support region and support means for the safety harness 20.

After the safety harness 20 is so attached to the shell 12 and positionable therewithin, the inner liner 14 is positioned within the shell 12. The leg portions 14*a* and 14*b*, of the inner liner 14 are positioned within the leg portions 12*a* and 12*b* of the outer shell 12. As the inner liner 14 is positioned within the shell 12, the leg portion 14*a* is moved through the support loop which comprises the support straps 36 and 38, and the leg portion 14*b* of the inner liner 14 is moved through the support loop which comprises the support straps 46 and 48.

Then the inner liner 14 is attached to the shell 12 in any suitable manner. Herein the inner liner 14 is provided with button snap connectors 70 which are attached to complementary button snap connectors 72 within the shell 12. Thus, the shell 12, and the safety harness 20 and the inner liner 14 become an apparel unit for donning and for wear by a firefighter.

Figure 7:
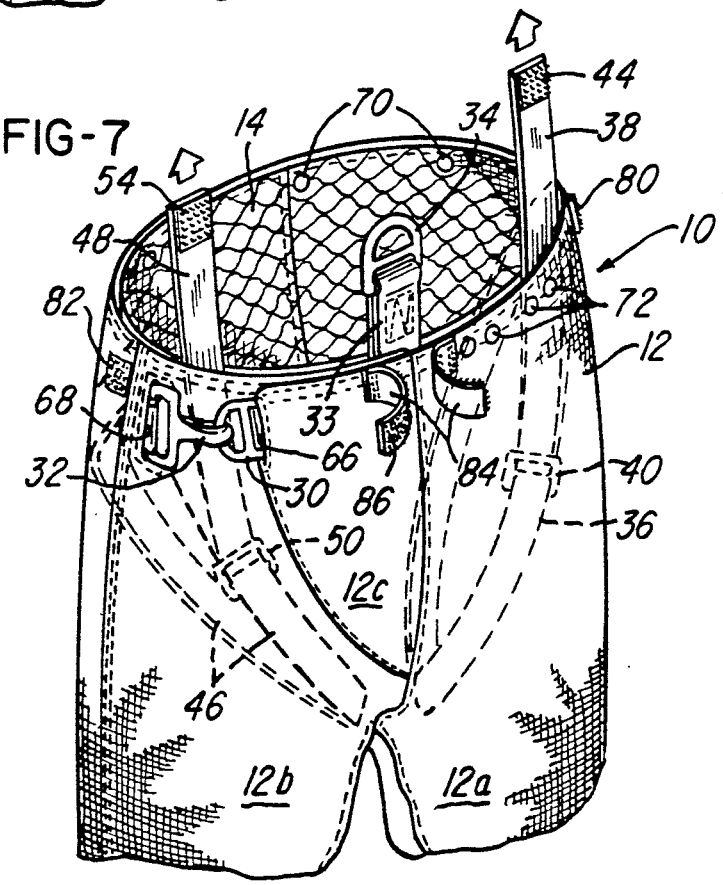
FIG. 7 is a fragmentary front perspective view, drawn on substantially the same scale as FIG. 4, showing a portion of the firefighter's trousers and safety harness unit as the safety harness is prepared for use in supporting a firefighter who wears the trousers.

The flaps 12*c* and 12*d* of the shell include hook and pile strips 74 and 76, respectively. Thus, as a firefighter dons the trousers 10 and the safety harness 20 as a unit, the firefighter's legs are within the leg portions 12*a* and 12*b* of the outer shell 12 and extend through the leg portions 14*a* and 14*b* of the inner 20 liner 14. The firefighter's legs also extend through the support loops formed by the support straps 36, 38, 46, and 48 which comprise leg encompassing parts and body support structure. As the trousers 10 and safety harness 20 are donned, the flap 12*c* is positioned upon the flap 12*d* of the shell 12, and the hook and pile strips 74 and 76 are attached together, as illustrated in FIG. 7. Thus, the flaps 12*c* and 12*d* comprise enclosure portions and closure means and complementary connection portions of the firefighter's trousers 10 for securing the firefighter's trousers 10 upon the firefighter who wears the firefighter's trousers 10. Then the snap connector 32 of the belt section 24*b* is attached to the annular connector member 30, as the snap connector 32 and the annular connector member 30 serve as fastener means. Thus, the firefighter's trousers 10 and safety harness 20 are secured upon the firefighter in the single operation of attaching the snap connector 32 to the annular connector member 30. Thus, the firefighter's trousers 10 and the safety harness 20 are donned as a unit.

Figure 8:
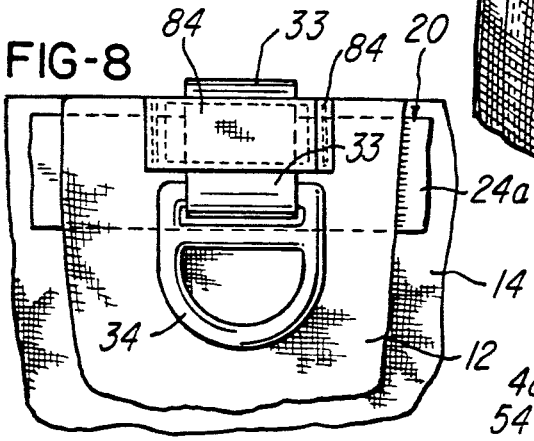
FIG. 8 is a fragmentary front view, drawn on a larger scale than the other figures, showing the safety harness support connection member in an inactive position.
Figure 5:
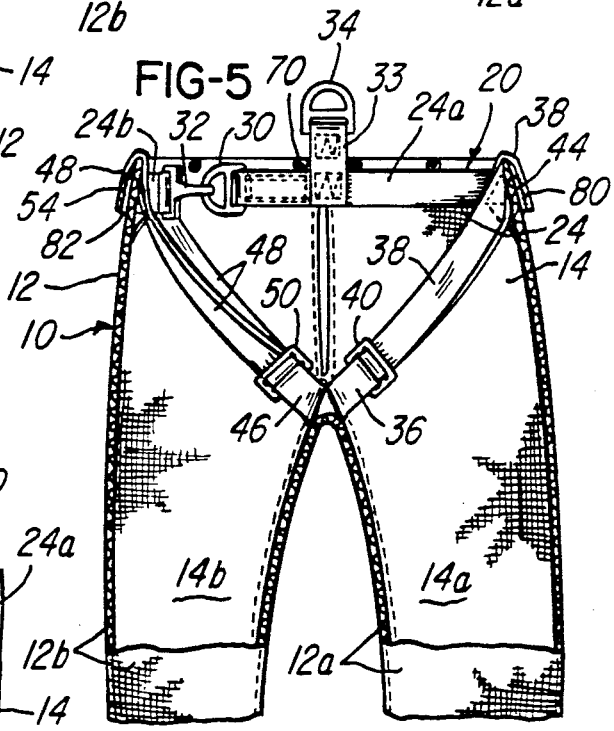
FIG. 5 is a fragmentary front view, with parts broken away and shown in section and drawn on a slightly smaller scale than FIG. 4, illustrating the firefighter's trousers and safety harness unit.
Figure 6:
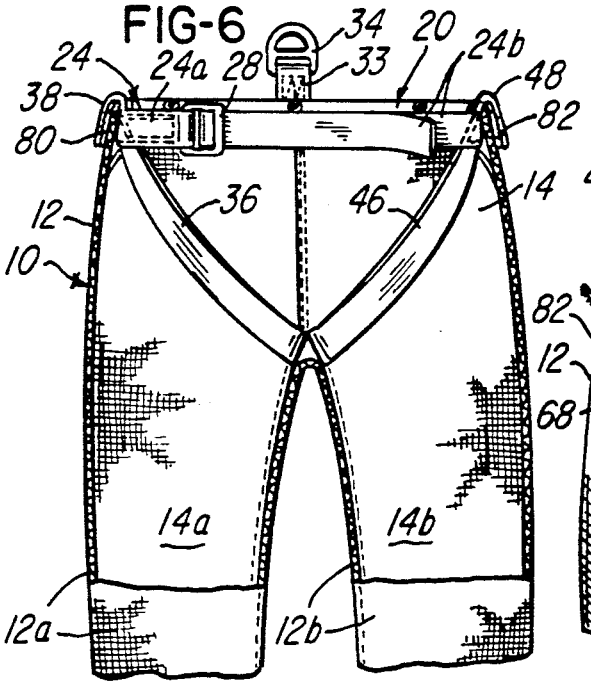
FIG. 6 is a fragmentary rear view, drawn on substantially the same scale as FIG. 5, with parts broken away and shown in section, illustrating the firefighter's trousers and safety harness unit.

In normal firefighting use of the trousers 10 and safety harness 20, the hook and pile element 44 at the end of the support strap 38 is attached to a complementary hook and pile element 80 which is on the exterior of the shell 12 at the upper part thereof. Also, the hook and pile element 54 at the end of the support strap 48 is attached to a hook and pile element 82 on the exterior of the shell 12 at the upper part thereof, as shown in FIGS. 5 and 6. Also, the short strap 33 hangs over the upper part of the shell 12 adjacent the front central part thereof and is retained in position by a pair of tabs 84 which are provided with complementary hook and pile attachment elements 86, as shown in FIG. 8.

Thus, as the firefighter wears the trousers 10 and the safety harness 20 as a unit the firefighter is prepared for firefighting activity in the upper floors of a skyscraper type of building or the like. Due to the fact that the safety harness 20 is within the trousers 10 and protected by the trousers 10, the safety harness 20 may be of lighter weight material than a conventional harness. Thus, the stress upon the firefighter is lessened. As stated and as shown, the only significant portion of the safety harness which is exterior of the trousers 10 is the short strap 33 and support connector member 34. Therefore, there are no hanging straps or the like exterior of the trousers 10 to become entangled in other elements as the firefighter is engaged in firefighting.

Figure 9:
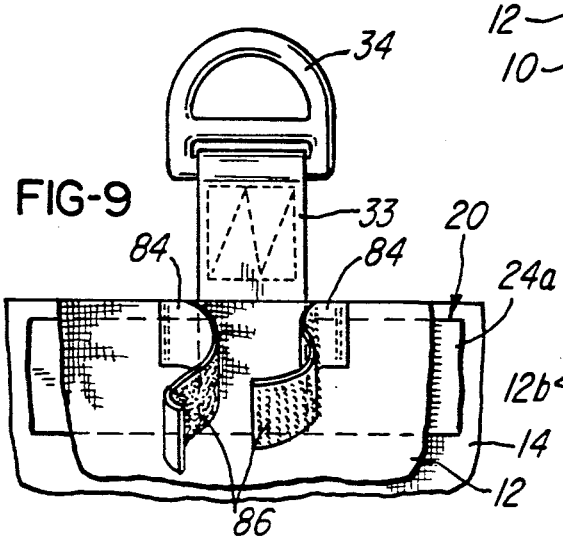
FIG. 9 is a fragmentary front view, similar to FIG. 8 and drawn on substantially the same scale as FIG. 8, showing the safety harness support connection member in an active position.

If a situation should occur in which the firefighter must descend outside the building, the firefighter detaches the end portions of the support straps 38 and 48 from the upper exterior part of the shell 12, from the positions thereof shown in FIGS. 5 and 6. Then the firefighter pulls the end portions of the support straps 38 and 48 upwardly, as illustrated in FIG. 7. As the firefighter pulls the support straps 38 and 48 upwardly, the support straps 38 and 48 slidably move within the slide fasteners 40 and 50, respectively. Thus, there is relative movement between the support strap 38 and the support strap 36, and there is relative movement between the support strap 48 and the support strap 46. Thus, the support loops formed by the support straps 36, 38, 46, and 48 become smaller, and the support loops formed by the support straps 36, 38, 46 and 48 come into firm supporting relationship with the leg portions 14*a* and 14*b* of the inner liner 14 at the upper leg portions of the firefighter. Then the firefighter releases the short strap 33 from the tabs 84 and moves the short strap 33 and the support connector member 34 from the positions thereof shown in FIG. 8 to the positions thereof shown in FIG. 9. Then the firefighter passes a support rope through the support connector member 34. Then as the support rope is firmly attached to an element or structure within the building, the firefighter, supported by the rope lowers himself or herself outside the building to a safe location.

A garment of this invention may comprise a combination in which a safety harness is attached to a firefighter's trousers, as a unit, with the safety harness exterior of the trousers.

Therefore, it is understood that a garment of this invention which comprises the firefighter's trousers 10 and safety harness 20 comprises a unit which is much more desirable than the conventional safety harness and firefighter's trousers which are separately donned by a firefighter.

Although the preferred embodiment of the firefighter's combination trousers and safety harness of this invention has been described, it will be understood that within the purview of this invention various changes may be made in the form, details, proportion and arrangement of parts, the combination thereof, the method of contruction and the method of use, which generally stated consist in a structure and a method within the scope of the appended claims.

The invention having thus been described, the following is claimed:

1. A pair of firefighter's trousers comprising firefighting protective material, the firefighter's trousers including a first enclosure portion and a second enclosure portion, the first enclosure portion and the second enclosure portion of the firefighter's trousers being positionable in desired relative positions to maintain the pair of firefighter's trousers upon the firefighter who wears the firefighter's trousers, a safety harness, the safety harness including a belt section which is adapted to encompass a portion of a firefighter who wears the firefighter's trousers, the safety harness also including a support part which is joined to the belt section and which extends downwardly from the belt section to support a firefighter who wears the firefighter's trousers, the safety harness also including a connection part which is joined to at least one of the enclosure portions of the firefighter's trousers, the connection part of the safety harness being movable to a desired position with respect to the first enclosure portion and the second enclosure portion of the firefighter's trousers to maintain the first and second enclosure portions of the firefighter's trousers in the desired relative positions thereof, and securing means attached to the connection part of the safety harness and operable to secure the position of the connection part of the safety harness in the desired position thereof and to secure the safety harness upon the firefighter who wears the firefighter's trousers, whereby the securing means is operable to secure the safety harness and the pair of firefighter's trousers upon the firefighter who wears the firefighter's trousers.

2. The firefighter's trousers of claim 1 in which the support part of the safety harness includes a leg encompassing part which encompasses a leg of the firefighter who wears the firefighter's trousers.

3. The firefighter's trousers of claim 1 in which the support part of the safety harness includes a leg encompassing part within the trousers which leg encompassing part encompasses a leg of the firefighter who wears the firefighter's trousers.

4. The firefighter's trousers of claim 1 in which the connection part of the safety harness is joined to the belt section of the safety harness.

5. In combination, a firefighter's trousers and safety harness for wear by a firefighter in which the firefighter's trousers include firefighting protective material, the safety harness including body support structure, the safety harness including complementary connector means, the complementary connector means including attachment portions which are attachable together to secure the safety harness upon the firefighter who wears the firefighter's trousers and safety harness combination, the firefighter's trousers including a support region which supports the safety harness, the firefighter's trousers also including closure means for securing the firefighter's trousers upon the firefighter, the support region of the firefighter's trousers including a portion of the closure means, means joining the complementary connector means of the safety harness to the closure means of the firefighter's trousers, whereby the attachment portions of the complementary connector means are attachable together to secure the firefighter's trousers upon the firefighter while securing the safety harness upon the firefighter.

6. A method of producing a firefighter's garment comprising providing firefighting protective material having flame resistant qualities and abrasion resistant qualities and having thermal barrier qualities and moisture barrier qualities, forming the firefighting protective material into a pair of trousers for wear by a firefighter, providing a support region in the pair of trousers, providing a safety harness which includes a support loop, attaching the safety harness to the support region of the pair of trousers, whereby the pair of trousers and the safety harness form a unit, the method including positioning the support loop within the pair of trousers, whereby as the firefighter dons the pair of trousers the firefighter also dons the safety harness.

7. The method of claim 6 which includes providing the safety harness with a pair of complementary connection members which are attachable together for attaching the safety harness to the firefighter who wears the pair of trousers, providing the pair of trousers with complementary connection portions which are attachable together for attaching the pair of trousers to the firefighter who wears the pair of trousers, joining the complementary connection members of the safety harness to the complementary connection portions of the pair of trousers, whereby attachment together of the pair of complementary connection members of the safety harness also attaches together the pair of complementary connection portions of the pair of trousers.

8. In combination, a firefighter's trousers and safety harness for wear by a firefighter in which the firefighter's trousers include firefighting protective material including flame resistant qualities and abrasion resistant qualities and including thermal barrier qualities and moisture barrier qualities, the safety harness including a plurality of complementary connector members, the complementary connector members being attachable together to secure the safety harness upon the firefighter who wears the firefighter's trousers and safety harness combination, the firefighter's trousers including support means which support the safety harness, the safety harness including a support part within the firefighter's trousers for support of the firefighter who wears the firefighter's trousers and safety harness combination, the firefighter's trousers also including closure means positionable to secure the firefighter's trousers upon the firefighter, means joining the complementary connector members of the safety harness to the closure means of the firefighter's trousers, whereby the complementary connector members are attachable together to secure the firefighter's trousers upon the firefighter and also to secure the safety harness upon the firefighter.

9. A firefighter's garment for wear by a firefighter, comprising a pair of firefighter's trousers including abrasion resistant and flame resistant material and thermal resistant material and moisture resistant material, a safety harness, the firefighter's trousers and the pair of firefighter's trousers also including a connection portion for securing the firefighter's trousers upon the firefighter who wears the firefighter's garment, the safety harness including fastener means for securing the safety harness upon the firefighter who wears the firefighter's garment, and attachment means connecting the fastener means of the safety harness to the connection portion of the firefighter's trousers, whereby the fastener means of the safety harness and the connection portion of the firefighter's trousers are joined together, and whereby the fastener means is operable to secure the safety harness and the firefighter's trousers upon the firefighter who wears the firefighter's garment.

10. A firefighter's garment comprising a pair of firefighter's trousers for wear by a firefighter, the firefighter's trousers including abrasion resistant and flame resistant material and thermal resistant and moisture resistant material, a safety harness, means for attaching the firefighter's trousers and the firefighter's trousers also including a plurality of connection portions which are positionable at desired relative positions to secure the firefighter's trousers upon the firefighter who wears the firefighter's trousers, the safety harness including securing means joined to the connection portions of the firefighter's trousers, the securing means being operable to secure the position of the safety harness upon the firefighter and to maintain the desired relative positions of the connection portions of the firefighter's trousers, whereby operation of the securing means secures the position of the pair of firefighter's trousers upon the firefighter and also secures the position of the safety harness upon the firefighter who wears the pair of firefighter's trousers.

11. A firefighter's trousers and safety harness combination for wear by a firefighter in which the firefighter's trousers include firefighting protective material, the safety harness including body support material, the combination including a plurality of complementary connector members, harness, the complementary connector members being attachable together to secure the safety harness upon the firefighter who wears the firefighter's trousers and safety harness combination, the firefighter's trousers including closure means for securing the firefighter's trousers upon the firefighter, means joining the complementary connector members of the safety harness to the closure means of the firefighter's trousers, and whereby the complementary connector members are attachable together to secure the firefighter's trousers upon the firefighter in addition to securing the safety harness upon the firefighter, the safety harness including support loop means having a part positioned within the firefighter's trousers for support of the firefighter who wears the firefighter's trousers and safety harness combination, the safety harness including a support member which is adapted to receive a support rope which supports a firefighter who wears the firefighter's trousers and safety harness combination.

* * * * *

UNITED STATES PATENT AND TRADEMARK OFFICE

CERTIFICATE OF CORRECTION

PATENT NO. : 5,136,724

DATED : August 11, 1992

INVENTOR(S) : William L. Grilliot and Mary I. Grilliot

It is certified that error appears in the above-identified patent and that said Letters Patent is hereby corrected as shown below:

Column 4, line 3, cancel "20".

Column 7, line 15, cancel "the firefighter's trousers and".

Column 7, line 33, cancel "means for attaching the";
line 34, cancel "firefighter's trousers and".

Column 8, line 17, cancel "harness,".

Signed and Sealed this

Fourteenth Day of September, 1993

Bruce Lehman

*Attest:*

BRUCE LEHMAN

*Attesting Officer*

*Commissioner of Patents and Trademarks*